US006559819B1

(12) United States Patent
Rumbaugh et al.

(10) Patent No.: US 6,559,819 B1
(45) Date of Patent: May 6, 2003

(54) METHOD FOR EXTENDING AN OPERATING RANGE OF A FIELD EMISSION DISPLAY AND CIRCUIT THEREFOR

(75) Inventors: Robert C. Rumbaugh, Scottsdale, AZ (US); Ken Foo, Gurney, IL (US)

(73) Assignee: Motorola, Inc., Schaumburg, IL (US)

( * ) Notice: Subject to any disclaimer, the term of this patent is extended or adjusted under 35 U.S.C. 154(b) by 332 days.

(21) Appl. No.: 09/617,705

(22) Filed: Jul. 17, 2000

(51) Int. Cl.[7] ..... G09G 3/22
(52) U.S. Cl. ..... 345/75.2; 345/74.1; 315/169.1
(58) Field of Search ..... 345/75.2, 74.1, 345/55; 315/169.1, 291, 297, 307

(56) References Cited

U.S. PATENT DOCUMENTS 4,922,241 A 5/1990 Inoue et al.
5,644,332 A 7/1997 Matsuzaki et al.
5,659,329 A * 8/1997 Yamanobe et al. ..... 313/309
5,834,900 A * 11/1998 Tanaka et al. ..... 313/495
5,936,354 A 8/1999 Smith et al. ..... 315/169.3
6,060,840 A 5/2000 Foo et al. ..... 315/169.1

FOREIGN PATENT DOCUMENTS

EP 0686960 12/1995
EP 0899766 3/1999

* cited by examiner

*Primary Examiner*—Bipin Shalwala
*Assistant Examiner*—Jimmy H. Nguyen
(74) *Attorney, Agent, or Firm*—William E. Koch; Kevin D. Wills

(57) ABSTRACT

A field emission display (100) includes a cathode plate (104) having a plurality of electron emitters (112), ballast resistors (118), an anode plate (120) having an anode (124), and a scan mode control circuit (130). The scan mode control circuit (130) is coupled to a video control circuit (160) via a scan mode switching circuit (150). The scan mode control circuit (130) cooperates with the scan mode switching circuit (150) and the video control circuit (160) to automatically switch between a single scan mode of operation and a multi-scan mode of operation.

16 Claims, 3 Drawing Sheets

METHOD FOR EXTENDING AN OPERATING RANGE OF A FIELD EMISSION DISPLAY AND CIRCUIT THEREFOR

FIELD OF THE INVENTION

The present invention relates, in general, to field emission displays and, more particularly, to methods and circuits for maintaining a substantially constant brightness of the field emission displays over temperature.

BACKGROUND OF THE INVENTION

Field emission displays (FED's) are well known in the art. A field emission display includes an anode plate and a cathode plate that define a thin envelope. Electron emitters are disposed on the cathode plate and conduct an electron emission current to the anode plate. To control the electron emission current, ballast resistors are provided between the electron emitters and the cathodes. The ballast resistors function to limit the electron emission current through each of the electron emitters and the cathodes. The FED generally requires high resistivity ballast resistors as part of the cathode design. The high resistivity materials used for ballast resistors are generally characterized by a large resistivity change as a function of temperature of the field emission display and cathode plate. This results in a very dramatic change in electron emission current over temperature for the FED when driven with a fixed voltage across the gate to cathode terminals, and consequently, a dramatic change in brightness of the FED over temperature.

Likewise, the gate to cathode voltage could be adjusted during operation in order to fix the emission current. In this mode of operation the change in ballast resistance over temperature may require voltages in excess of the ability of either the drive electronics or the FED structure to operate reliably, thus reducing the practical temperature range achievable.

Accordingly, there exists a need for a method and circuitry for maintaining a substantially constant brightness in a field emission display over wider variations in temperature.

BRIEF DESCRIPTION OF THE INVENTION

For simplicity and clarity of illustration, elements in the drawings are not necessarily drawn to scale, and the same reference numerals in different figures denote the same elements.

DETAILED DESCRIPTION OF THE DRAWINGS

Generally, the present invention is for a field emission display capable of automatically switching between a single scan mode of operation and a multi-scan mode of operation dependent on the operating temperature. In accordance with an embodiment of the present invention, a voltage is developed by injecting a fixed current into a temperature sensing element, which is made from the same material as the ballast resistor and located physically in or near the active array of emitters, in order to be at approximately the same temperature. This voltage is monitored and used to set the gate voltage to the emitters. In addition when the total gate voltage exceeds a predetermined threshold, the scan mode and the gate voltage are adjusted simultaneously in amounts designed to provide identical brightness levels on both sides of the transition. For example, if the temperature decreases, the voltage across the temperature sensing element increases. If the voltage across the temperature sensing element increases such that the gate voltage at the cathode plate increases above a predetermined value or critical value the circuitry automatically and seamlessly switches the mode of operation from single scan to multi-scan. Likewise, if the voltage across the temperature sensing element increases such that the voltage at the gate of the cathode plate decreases below the predetermined value, the circuitry automatically and seamlessly switches its mode of operation from multi-scan to single scan. Thus, the present invention improves the performance capability of the field emission display at low temperatures.

Figure 1:
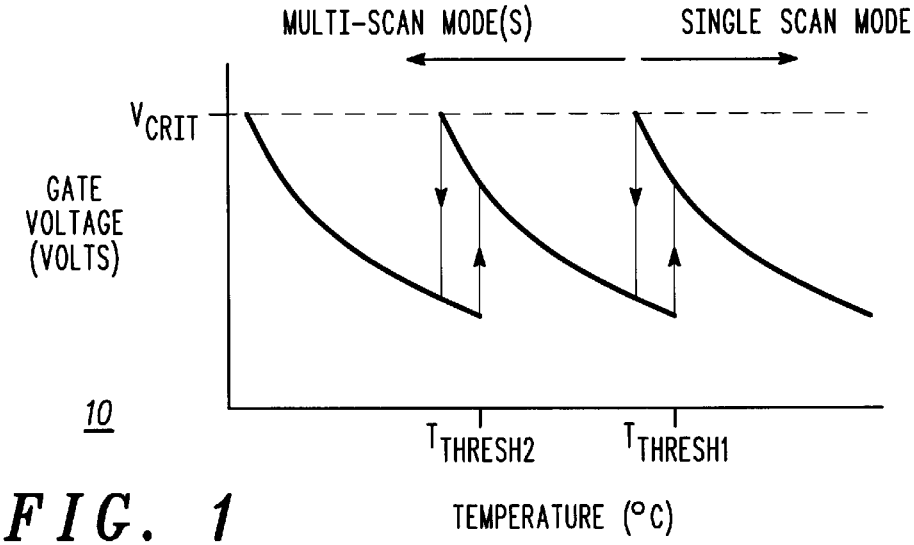
FIG. 1 is a graphical illustration of the change in gate voltage over temperature during operation in accordance with the present invention.

FIG. 1 is a graphical illustration 10 of the change of gate voltage over temperature during operation of the field emission display in accordance with the present invention. At temperatures greater than $T_{THRESH1}$, field emission displays in accordance with the present invention have a gate voltage that is within acceptable operating specifications for the single scan mode of operation, i.e., below the critical gate voltage $V_{CRIT}$. Thus, the field emission display operates in a single scan mode of operation. As the temperature decreases, the gate voltage of the field emission display increases and, if the gate voltage increases to a value greater than $V_{CRIT}$, the field emission display automatically switches to a multi-scan mode of operation such as, for example, a double scan mode. When the field emission display switches to the double scan mode of operation, the gate voltage drops below the critical voltage. As the temperature further decreases, the gate voltage increases. If the temperature falls below $T_{TRESH2}$, the gate voltage of the field emission display increases above the critical gate voltage $V_{CRIT}$ and the field emission display enters the tri-scan mode of operation.

It should be noted that the field emission display is designed to have hysteresis around the threshold temperatures $T_{THRESH1}$ and $T_{THRESH2}$. It should be further understood that the number of modes and threshold voltages is not a limitation of the present invention.

Figure 2:
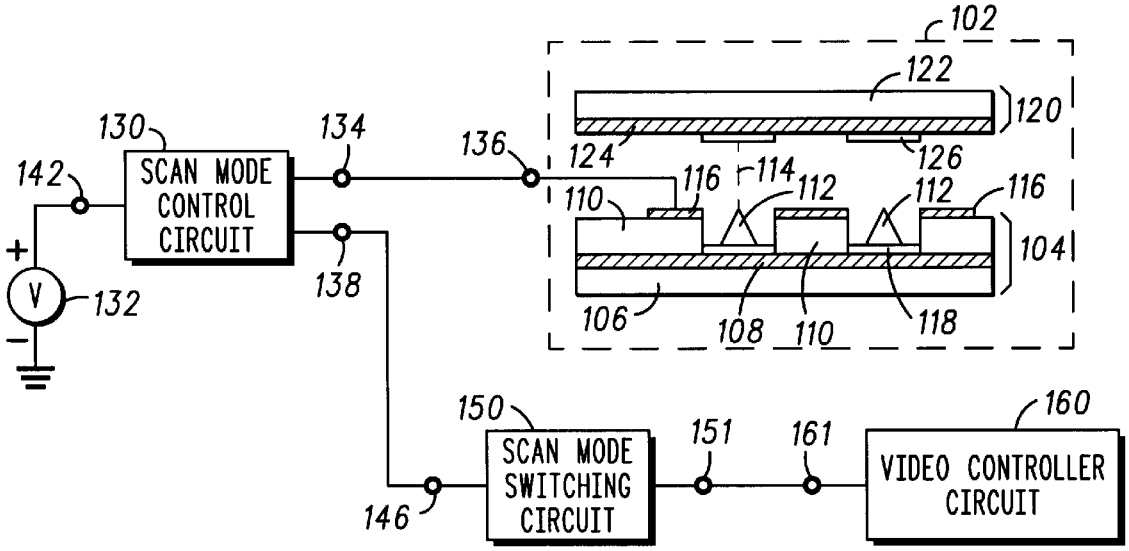
FIG. 2 is a cross-sectional view in combination with a circuit diagram of a field emission display in accordance with an embodiment of the present invention.

FIG. 2 is a cross-sectional view in combination with a circuit diagram of a field emission display 100 in accordance with a specific implementation of an embodiment of the present invention. Field emission display 100 includes a display device 102, a scan mode control circuit 130, a scan mode switching circuit 150, and a video controller circuit 160.

Display device 102 includes a cathode plate 104 and an anode plate 120 in registration with cathode plate 104. Cathode plate 104 includes a substrate 106, which can be made from glass, silicon, and the like. A plurality of cathodes 108 is disposed on substrate 106. Cathodes 108 can include a plurality of ballast resistors 118 for limiting electron emission current 114 through electron emitters 112. A dielectric layer 110 is disposed upon cathodes 108 and substrate 106, and further defines a plurality of wells.

An electron emitter 112 is disposed in each of the wells. Anode plate 120 is disposed to receive electron emission current 114 emitted by electron emitters 112. A plurality of gates 116 is formed on dielectric layer 110 proximate to the wells. Cathodes 108 and gates 116 are used to selectively address electron emitters 112.

To facilitate understanding, FIG. 2 depicts only a few gates and one cathode. However, it is desired to be understood that any number of gates and cathodes can be employed. An exemplary number of gates for display device 102 is 240 gates, and exemplary number of cathodes is 720 cathodes. Methods for fabricating cathode plates for matrix-addressable field emission displays are also well known to one of ordinary skill in the art.

Anode plate 120 includes a transparent substrate 122 made from, for example, glass. An anode 124 is disposed on transparent substrate 122. By way of example, anode 124 is a continuous layer that opposes the entire emissive area of cathode plate 104. That is, anode 124 opposes the entirety of electron emitters 112. A plurality of phosphors 126 is disposed upon anode 124. Methods for fabricating anode plates for matrix-addressable field emission displays are also known to one of ordinary skill in the art.

An input 142 of scan mode control circuit 130 is designed to be connected to an unregulated voltage 132. An output 134 of scan mode control circuit 130 is connected to input 136 of gate 116. A scan mode control output 138 of scan mode control circuit 130 is connected to an input 146 of scan mode switching circuit 150.

An output 151 of scan mode switching circuit 150 is connected to an input 161 of video controller circuit 160. Video controller circuit 160 operates field emission display 100 in either single scan mode or multi-scan mode. Although the preferable multi-scan mode is double scan mode, it should be understood this is not a limitation of the present invention. For example, video controller circuit 160 can operate field emission display 100 in tri-scan mode, quadra-scan mode, penta-scan mode, etc. Switching between these modes could be done sequentially at decreasing temperature levels, further extending the practical temperature range of the display.

Figure 3:
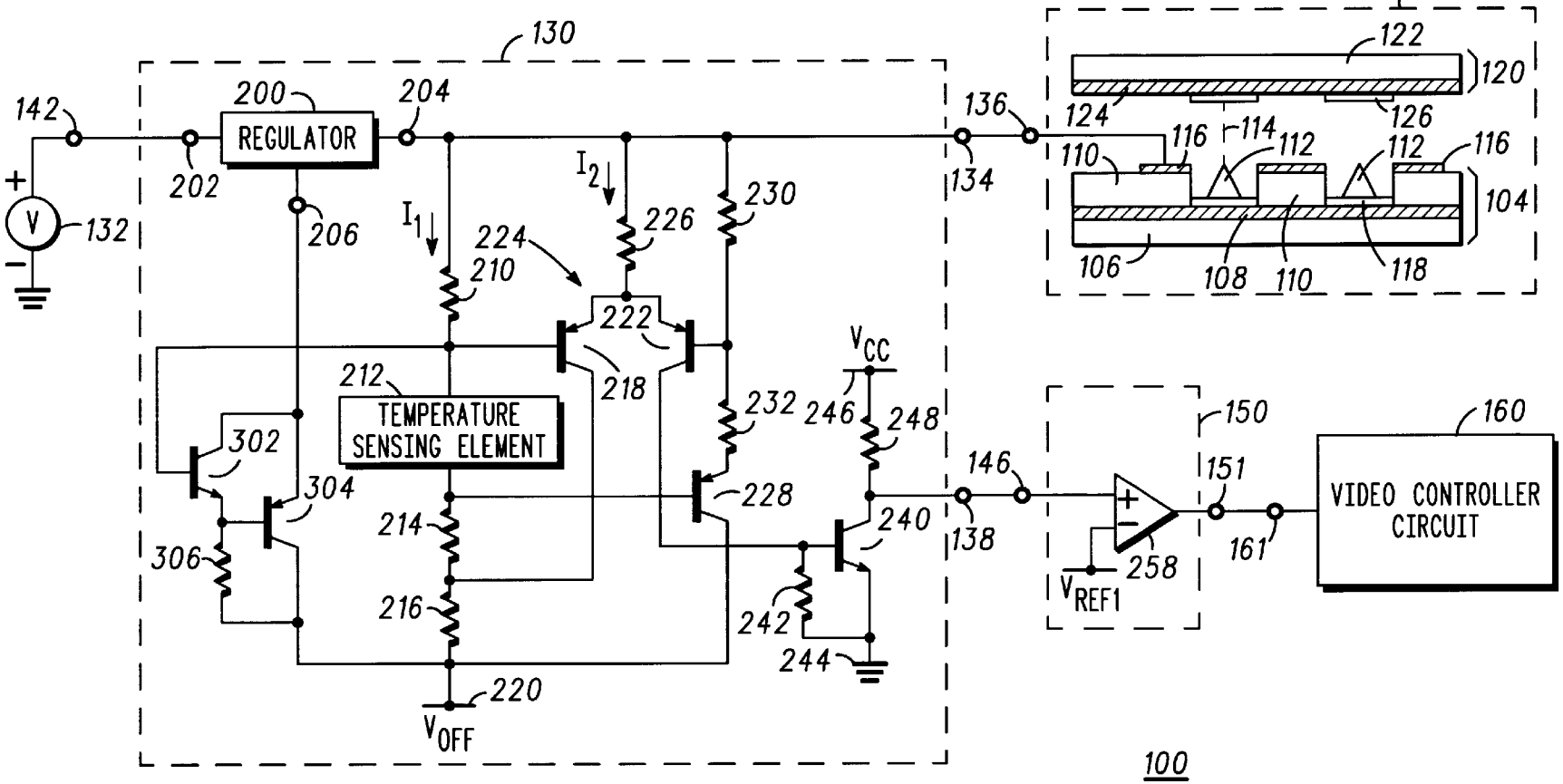
FIG. 3 is a cross-sectional view in combination with a circuit diagram of a field emission display in accordance with another embodiment of the present invention.

FIG. 3 is cross-sectional diagram in combination with a circuit diagram of field emission display 100 in accordance with an embodiment of the present invention. In the embodiment of FIG. 3, scan mode control circuit 130 includes a regulator 200 having an input terminal 202 connected to unregulated voltage 132 via an input 142. Regulator 200 further includes a terminal 204 connected to output terminal 134 and a terminal 206 connected to transistors 302 and 304. In particular, the collector terminal of transistor 302 is connected to the emitter terminal of transistor 304 and both terminals 302 and 304 are connected to terminal 206. The second terminal of resistor 306 is connected to the collector terminal of transistor 304. The collector terminal of transistor 304 is coupled for receiving an offset voltage 220. The base terminal of transistor 302 is connected to the base terminal 218 and to resistors 210 and 212. Preferably, resistor 210 is a zero temperature coefficient resistor that sets the current $I_1$ flowing into a temperature sensing element 212.

By way of example, temperature sensing element 212 is a resistor having a first terminal connected to the base terminals of transistors 302 and 218 and to the first terminal of resistor 210. A second terminal of temperature sensing element 212 is commonly connected to the base terminal of transistor 228 and to the first terminal of a resistor 214. A second terminal of resistor 214 is commonly connected to the first terminal of a resistor 216 and to the collector terminal of transistor 218. A second terminal of resistor 216 is connected to offset voltage 220. The collector terminal of transistor 228 is connected to offset voltage 220.

Transistor 218 cooperates with transistor 222 to form a differential pair 224. Accordingly, the emitter terminal of transistor 222 is connected to the emitter terminal of transistor 218. The commonly connected emitter terminals of transistors 218 and 222 are coupled to terminal 204 via a resistor 226. The base terminal of transistor 222 is coupled to terminal 204 via a resistor 230 and to the emitter terminal of transistor 228 via a resistor 232.

The collector terminal of transistor 222 is connected is connected to the base terminal of a transistor 240 and to a source of operating potential 244 via a resistor 242. By way of example, source of operating potential 244 is ground. The collector electrode of transistor 240 is coupled to a source of operating potential 246 via a resistor 248. The collector terminal of transistor 240 is coupled to an output terminal 238 of scan control circuit 130, which is connected to input terminal 146 of scan switching circuit 150.

In accordance with the present invention, scan switching circuit 150 comprises of a comparator 256, wherein this comparator provides hysteresis for the purpose of noise immunity. The inverting input of comparator 256 is coupled for receiving a reference voltage $V_{REF1}$.

The operation of field emission display 100 will now be described with reference to FIG. 3. Regulator 200 receives unregulated voltage 132 and outputs a regulated voltage, $V_{GATE}$, to node 134. Temperature sensitive element 212 is designed such that when the operating temperature increases causing the gate voltage to decrease below a predetermined threshold voltage, differential pair 224 operates such that substantially all of current $I_2$ flows through transistor 218, i.e., all the current $I_2$ is steered through transistor 218 and essentially no current flows through transistor 222. It should be noted that ratio of the resistor value of resistor 230 to the resistor value of resistor 232 are designed to set when the current flowing through resistor 212 is sufficient to change the scanning mode of operation. Thus the gate voltage $V_{GATE}$ appearing at node 134 is given by:

$$V_{GATE}=V_{REG}+I_1*R_{212}+I_1*R_{214}+(I_1+I_2)*R_{216}$$

where:

$V_{GATE}$ is the regulated output voltage at node 134

$V_{REG}$ is a specified voltage across regulator 200 from terminal 206 to terminal 204;

$I_1*R_{212}$ is the voltage across resistor 212;

$I_1*R_{214}$ is the voltage across resistor 214; and $(I_1+I_2)*R_{216}$ is the voltage across resistor 216.

In this mode, the voltage appearing at input terminal 146 of scan switching circuit 150 is source of operating potential 246 which is typically identified as $V_{CC}$. This voltage serves as an input to comparator 256 of scan switching circuit 150 such that comparator 256 outputs a logic low voltage value at output terminal 261. Under this condition video controller 260 places field emission display 10 in a single scan mode of operation.

When the operating temperature decreases causing the gate voltage to increase above a predetermined threshold voltage, differential pair 224 operates such that substantially all of current $I_2$ flows through transistor 222, i.e., all the current $I_2$ is steered through transistor 222 and essentially no current flows through transistor 218. Thus the voltage $V_{GATE}$ appearing at node 134 is given by:

$$V_{GATE}=V_{REG}+I_1*R_{212}+I_1*R_{214}+I_1*R_{216}$$

where:

$V_{ROW}$ is the regulated output voltage at node 134

$V_{REG}$ is a specified voltage across regulator 200 from terminal 206 to terminal 204;

$I_1*R_{212}$ is the voltage across resistor 212;

$I_1*R_{214}$ is the voltage across resistor 214; and $I_1*R_{216}$ is the voltage across resistor 216.

In this mode, the voltage appearing at input terminal 146 of scan switching circuit 150 is source of operating potential 244 which is typically ground. This voltage serves as an input to comparators 256 of scan switching circuit 150 such that comparator 256 outputs a logic high voltage value at output terminals 261. Under this condition video controller 160 places field emission display 10 in a multi-scan mode of operation.

Figure 4:
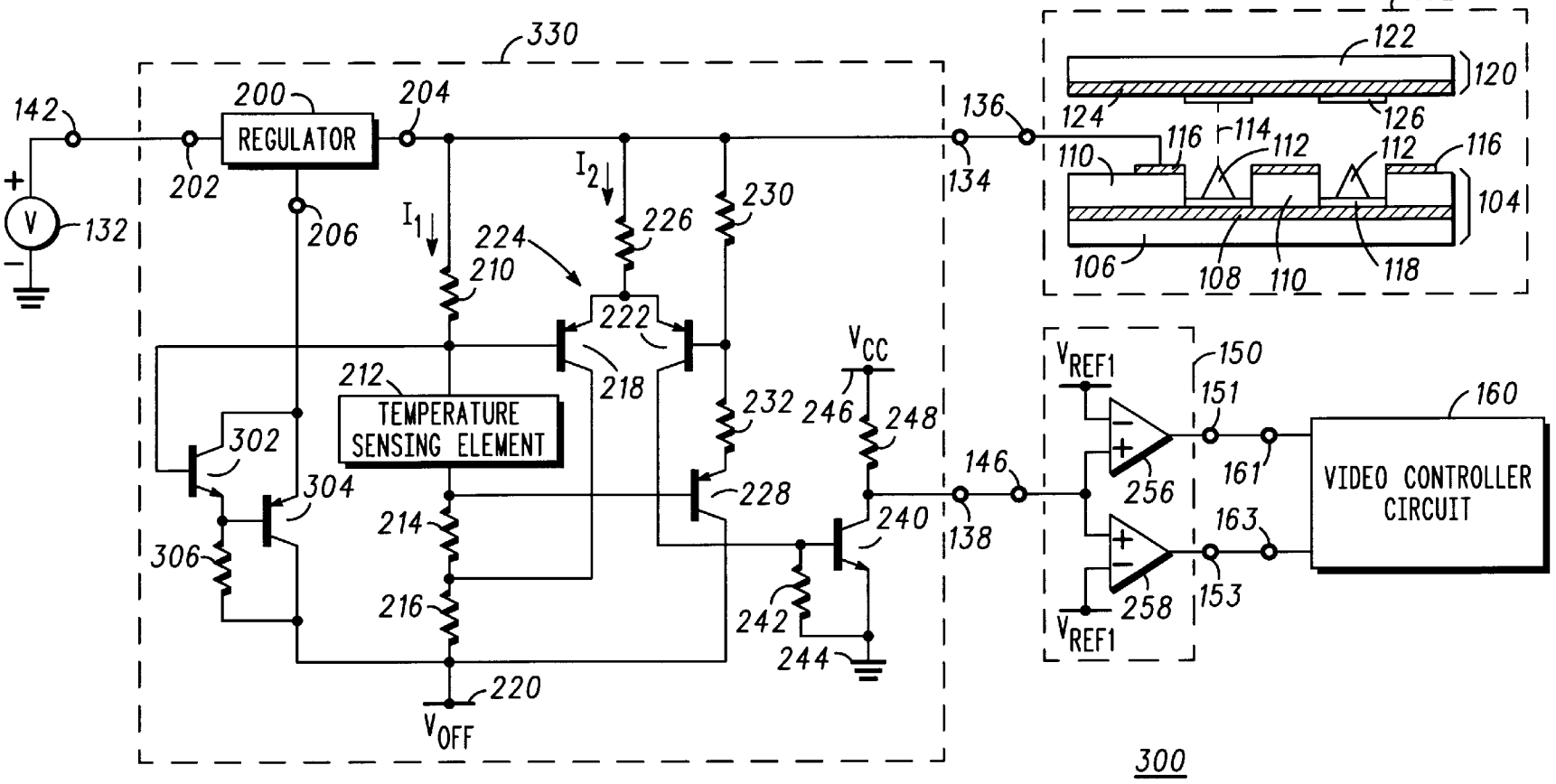

Referring to FIG. 4, the field emission display 300 is similar to the field emission display 100 of FIG. 3, having like numbers, except that the scan switching circuit 150 comprises fast and second comparators 256 and 258 for providing hysteresis for the purpose of noise immunity. Outputs 151 and 153 of scan mode switching circuit 150 are connected to inputs 161 and 163, respectively, of video controller circuit 160.

Although the transistors have been shown as bipolar transistors, it should be understood this is not a limitation of the present invention, i.e., the transistors can be field effect transistors. It should be further understood that for a bipolar transistor the emitter and collector terminal serve as conducting terminals and the base terminal serves as the control terminal, whereas for a field effect transistor the drain and source terminals serve as the conducting terminals and the gate terminal serves as the control terminal.

By now it should be appreciated that a field emission display having the capability of automatically switching between a single scan mode of operation and a multi-scan mode of operation and a method of switching between scan modes have been provided. The voltage signal across a temperature sensing element is monitored and the scan mode is adjusted in accordance with the monitored voltage signal. The present invention allows switching between scan modes in order to maintain constant brightness over a wider range of temperature, at the expense of a small loss of display image quality at extreme temperatures. Thus, the maximum performance is maintained where the field emission display will operate from the vast majority of the time.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention. For example, the circuitry used for switching between the different modes of operation may be implemented using a microprocessor and additional control circuitry. In addition, the particular implementation for the scan mode switching circuit is not limited to the use of a comparator with hysteresis. Further, the combination of transistors 302, 304, and resistor 306 can be replaced by a single transistor.

What is claimed is:

1. A method for extending an operating temperature range of a field emission display, comprising:

monitoring a first signal of the field emission display, the first signal having a temperature dependence;

adjusting a scan mode in accordance with the monitored first signal.

2. The method of claim 1, wherein adjusting the scan mode includes changing the scan mode from a single scan mode to a multi-scan mode.

3. The method of claim 2, wherein the multi-scan mode is a double scan mode.

4. The method of claim 2, wherein changing the scan mode includes changing from the single scan mode to the multi-scan mode when the temperature decreases.

5. The method of claim 4, further including changing from the single scan mode when a gate voltage of the field emission display increases above a critical voltage.

6. The method of claim 1, wherein monitoring the first signal comprises monitoring a voltage signal.

7. The method of claim 1, wherein adjusting the scan mode includes changing a gate voltage.

8. The method of claim 1, wherein adjusting the scan mode includes switching the scan mode when a gate voltage crosses a predetermined threshold voltage.

9. The method of claim 8, wherein crossing the predetermined threshold voltage comprises the gate voltage becoming greater than the threshold voltage.

10. A method for extending a temperature range over which a field emission display can maintain a substantially constant brightness, comprising:

providing a field emission device having an anode plate and a cathode plate, the cathode plate having a gate;

coupling a temperature sensing circuit to the gate;

operating the field emission display in one of a single scan mode or a multi-scan mode;

monitoring a signal from the temperature sensing circuit; and switching the scan mode of the field emission display when the monitored signal from the temperature sensing circuit crosses a predetermined value.

11. The method of claim 10, wherein monitoring the signal comprises monitoring a voltage signal.

12. The method of claim 10, wherein switching the scan mode includes switching the scan mode from single scan to multi-scan when the temperature decreases below a temperature threshold value or the gate voltage increase above the predetermined value.

13. The method of claim 10, wherein switching the scan mode includes switching the scan mode from multi-scan to single scan when the temperature increases above a temperature threshold value and the gate voltage decreases below a predetermined value.

14. The method of claim 10, wherein coupling the temperature sensing circuit includes coupling a scan mode control circuit to the gate, wherein the temperature sensing circuit comprises a resistor.

15. A field emission display, comprising:

a cathode plate having a plurality of electron emitters;

an anode plate disposed to receive an electron emission current from said plurality electron emitters; and a scan mode control circuit coupled to the cathode plate, comprising:

a regulator having first, second, and third terminals, the first terminal coupled for receiving a voltage;

a temperature sensing circuit coupled between the second terminal and a source of operating potential;

a differential pair having a first control input coupled to the third terminal;

a voltage reference network coupled to the second control input of the differential pair; and an output circuit coupled between the voltage reference network and the source of operating potential.

16. The field emission display of claim 15, wherein the temperature sensing circuit comprises a resistor.

* * * * *